US005738160A

United States Patent [19]

Rice

[11] Patent Number: 5,738,160

[45] Date of Patent: Apr. 14, 1998

[54] REMOVABLE COVER FOR AUTOMOBILE SERVICE PIT AND METHOD OF INSTALLATION

[75] Inventor: Ben K. Rice, Houston, Tex.

[73] Assignee: BRW Unlimited Services, Inc., Houston, Tex.

[21] Appl. No.: 746,862

[22] Filed: Nov. 18, 1996

Related U.S. Application Data

[63] Continuation-in-part of Ser. No. 354,555, Dec. 13, 1994, abandoned.

[51] Int. Cl.[6] ..... E06B 9/06

[52] U.S. Cl. ..... 160/84.06; 160/201; 160/378; 52/169.7

[58] Field of Search ..... 160/133, 201, 160/327, 328, 354, 236, 84.06, 273.1, 274, 290.1, 378, 270, 188; 52/169.6, 169.7

[56] References Cited

U.S. PATENT DOCUMENTS 2,088,072 7/1937 Tobin .
2,612,221 9/1952 Dellapent .
2,844,196 7/1958 Jones .
4,341,253 7/1982 Eyerle .
4,628,646 12/1986 Eyerle .
4,966,217 10/1990 Dechambeau et al. .

*Primary Examiner*—Blair Johnson
*Attorney, Agent, or Firm*—Bush, Riddle & Jackson, L.L.P.

[57] ABSTRACT

A safety cover (36) for an opening (16) formed by an automotive service pit (14). The cover (36) is formed of a plurality of longitudinal columns (46) of a webbing material, and a plurality of transverse rows (48, 50) of webbing material stitched to each other to form a flexible safety cover. Looped ends (60) of alternate rows (48) of the webbing material are mounted by end support members (54) for sliding movement along a pair of side guide rails (38) between covered and uncovered positions of the opening (16). One end of the movable cover (36) has a fixed bar (70) on which looped columns (46) of the webbing material are secured. The other opposite end of the cover (36) have looped columns (46) around a movable end bar or rod (80) which may be releasably locked by a locking mechanism (90). One embodiment of the invention shown in FIGS. 10–14 discloses a safety cover (36C) supported on cables (41C) for sliding movement between open and closed portions.

13 Claims, 5 Drawing Sheets

FIG. 3
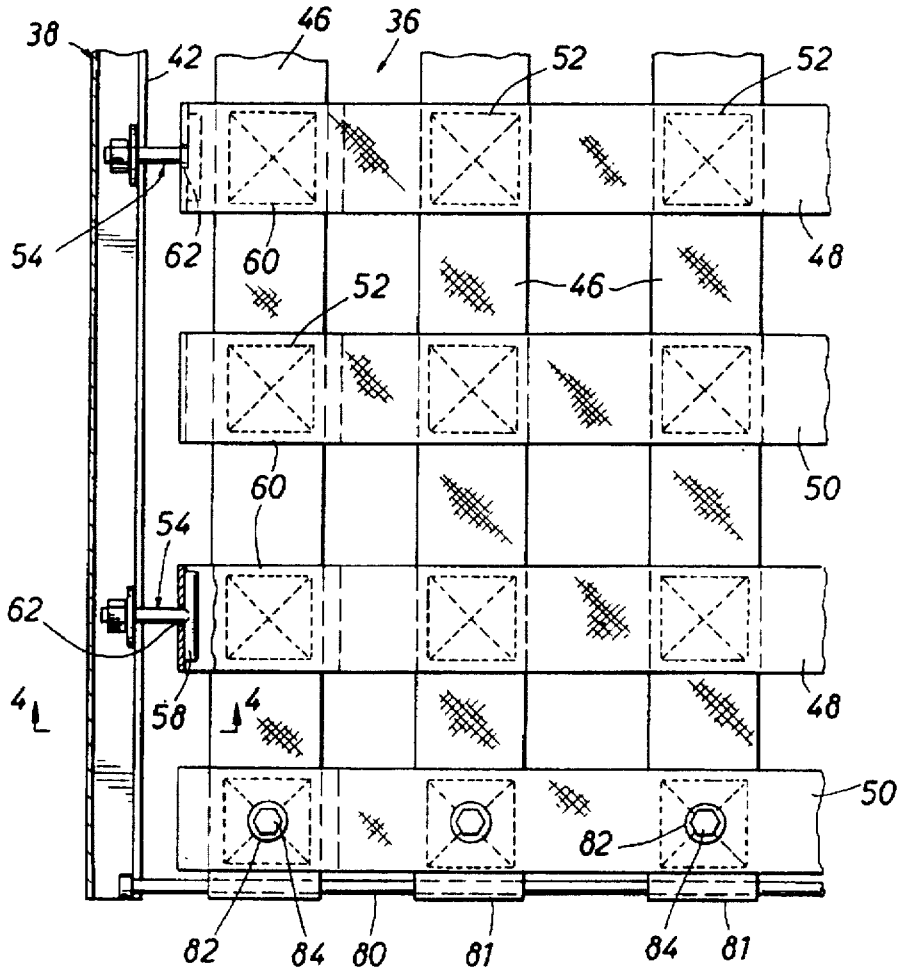
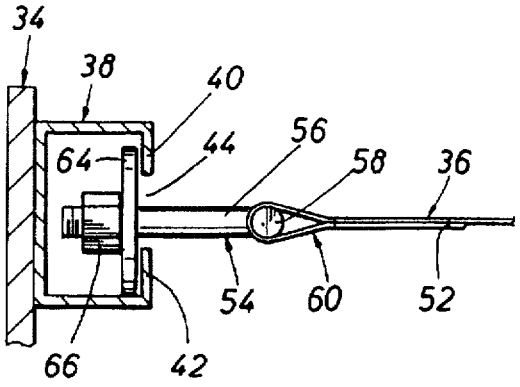
FIG. 4
FIG. 8
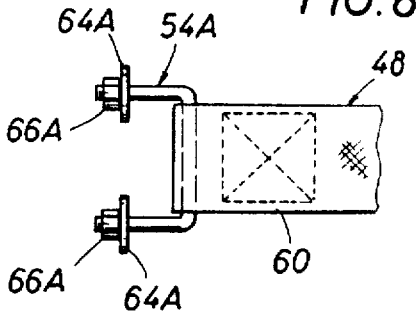
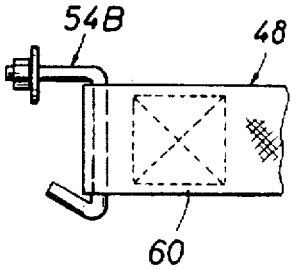
FIG. 9

FIG. 5
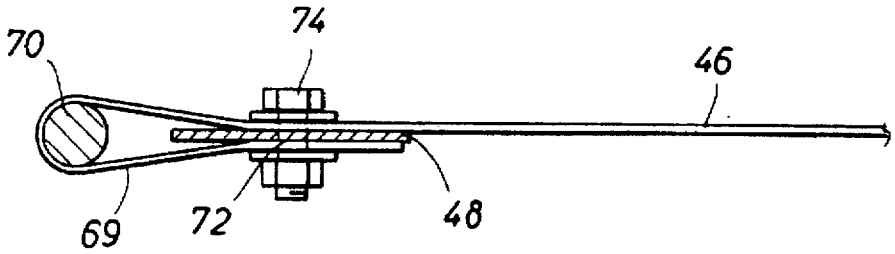
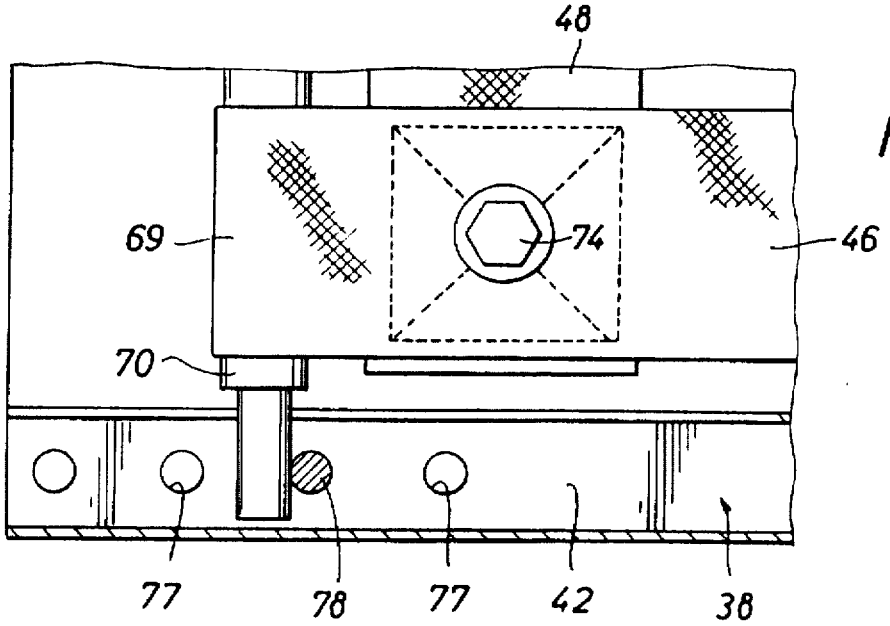
FIG. 6
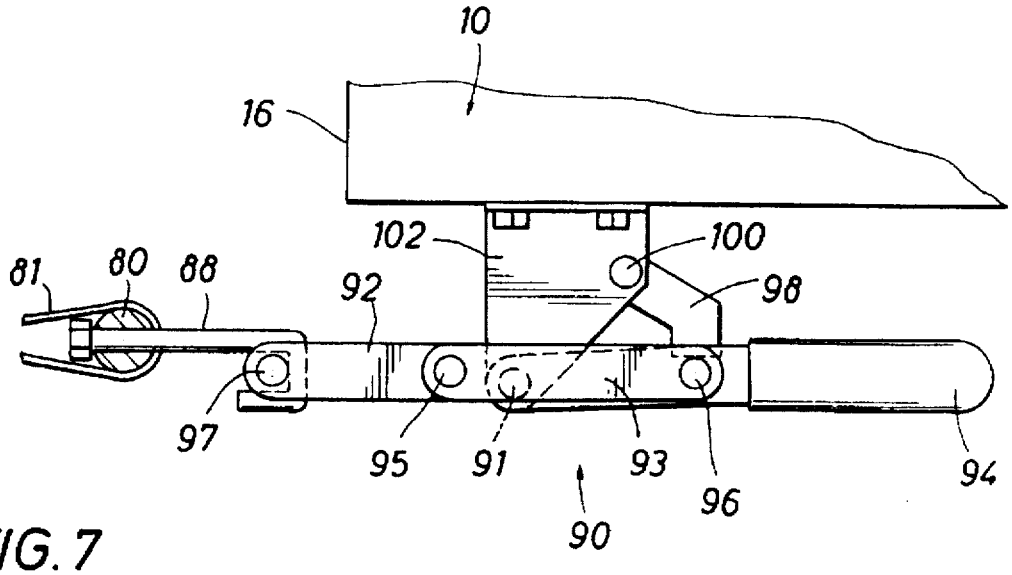
FIG. 7

FIG. 10
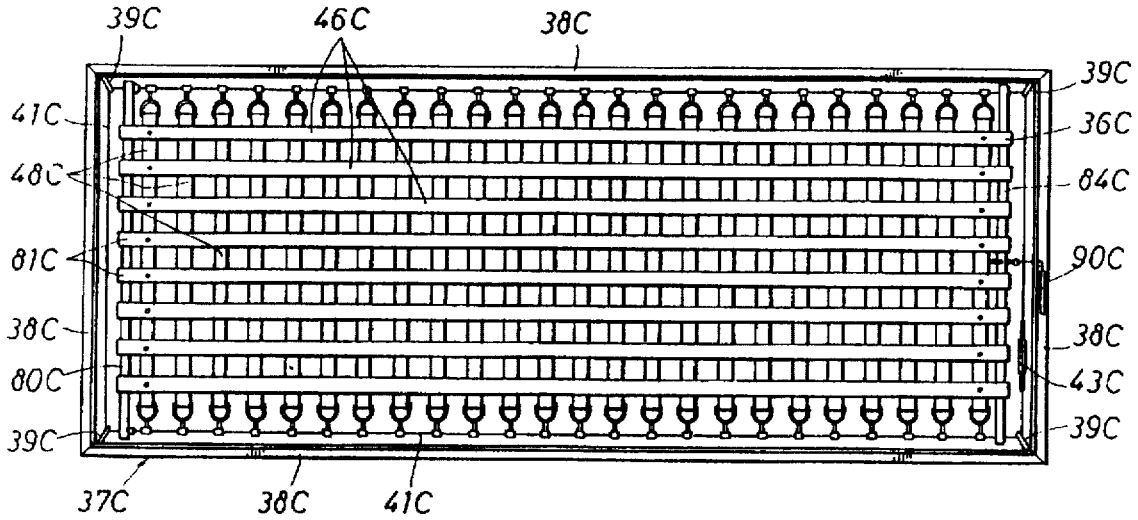
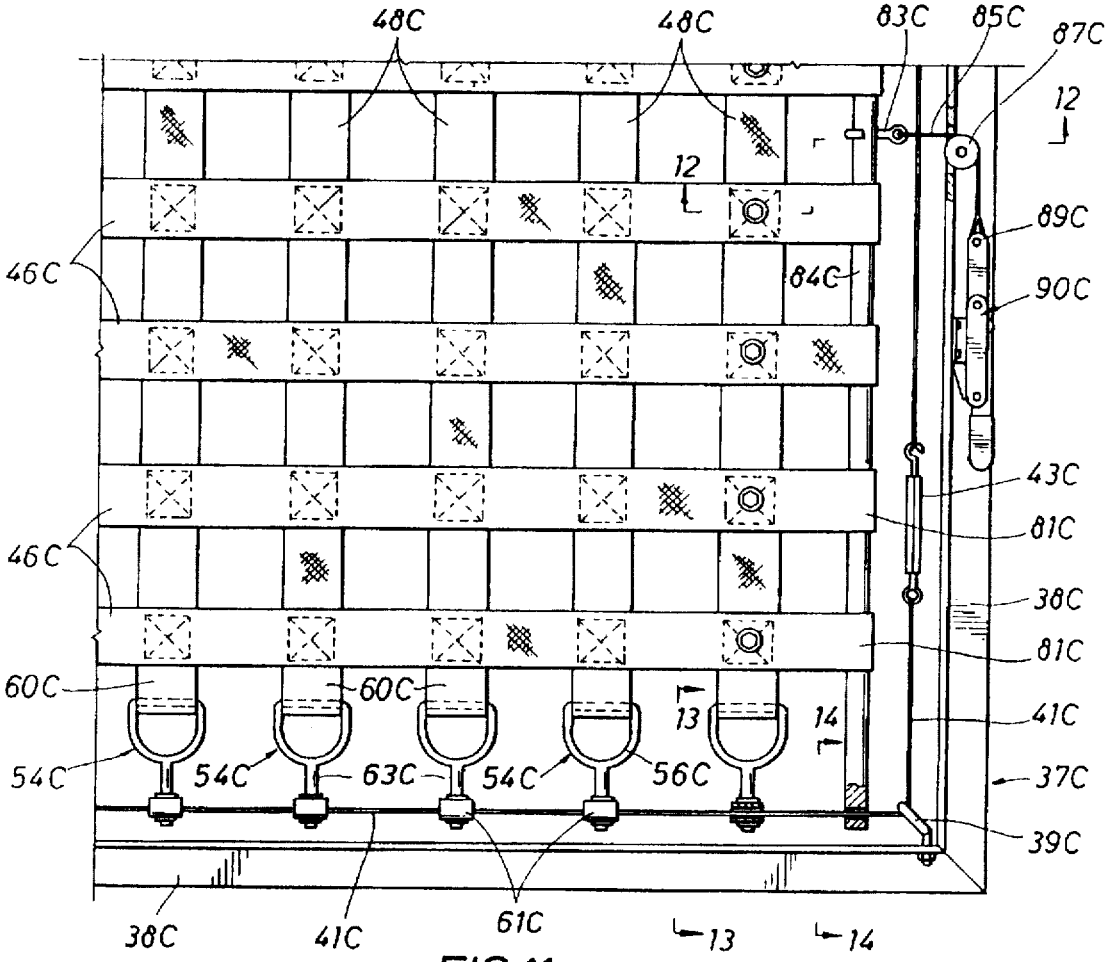
FIG. 11

REMOVABLE COVER FOR AUTOMOBILE SERVICE PIT AND METHOD OF INSTALLATION

REFERENCE TO RELATED APPLICATION

This application is a continuation in part of application Ser. No. 08/354,555, abandoned, filed Dec. 13, 1994.

FIELD OF THE INVENTION

This invention relates to a safety cover for the floor opening of an automotive service pit and method of installation, and more particularly to a safety cover formed of a flexible material and mounted for selective movement between covered and uncovered positions of the floor opening.

BACKGROUND OF THE INVENTION

Automotive service pits are located below the floor on which the vehicles to be serviced are positioned, and the floor has an opening for access by workmen in the pit to the underside of the automotive vehicle. Particularly when the service pit is not being used, the floor opening could be a safety hazard and it is desirable to close the opening with a removable cover.

Heretofore, such as shown in U.S. Pat. No. 4,966,217, safety covers have been positioned over the floor openings in the automotive services pits to cover the pits when not in use. However, such safety covers have been formed of substantially rigid members, such as metal bars, which extend between supporting parallel guide rails mounted along opposite sides of the floor opening. The cover in the '217 patent is divided into two halves, each of which may be pushed to one end of the opening for storing when the pit is being used by workmen for the servicing of automotive vehicles. A chain connects the metal bars to each other and when the cover is retracted the bars and associated roller chain segments are stored within a pocket or well adjacent an end of the floor opening The assembly of the rigid bars and chain segments is time consuming and costly. Periodic lubrication of the chain is also required to decrease the friction between the chain segments and the guide rails mounting the chain elements and rigid bars. Also, a substantial force is required to push or slide the metal bars and chain segments along the supporting guide rails to a storage area at the end of the rails.

It is desired to have a safety cover for the floor opening of an automotive service pit which eliminates chains and rigid bars for the cover thereby to simplify installation of the cover and the movement of the cover between covered an uncovered positions of the floor opening for the service pit.

While a fabric safety cover has been used before, such fabric covers have not utilized a webbing material, and particularly a plurality of spaced columns of webbing material having a plurality of transverse rows of webbing material stitched to the columns.

SUMMARY OF THE INVENTION

The present invention is directed to a removable safety cover for the floor opening of an automotive service pit, and more particularly to a cover formed of a pliant flexible material for selective movement to a desired side of the pit for uncovering the floor opening. Upon recovery of the floor opening workmen in the service pit below an automotive vehicle are provided access to the underside of the vehicle for servicing the vehicle.

The flexible material forming the preferred embodiment of the cover preferably comprises a web netting material formed of a plurality of spaced longitudinally extending parallel strips stitched to a plurality of transversely extending parallel strips. Alternate transverse strips are looped over slidable anchors which are manually movable to a retracted position of the cover at the end of the opening. The strips are preferably formed of a relatively tough webbing or belting material of a thickness sufficient to support workmen standing on the cover. The flat webbing material is easily looped over metal support brackets and then stitched for securement to the support brackets. Each end of the alternate transverse strips is secured to a bracket and the bracket is mounted within a slot in a C-shaped channel member secured to the floor adjacent the opening for the service pit. One end of each longitudinally extending strip is secured to a movable rod adjacent the other end of the floor opening. The movable rod is preferably connected to a releasable locking mechanism so that the safety cover can be locked in the covered position of the floor opening. Upon locking of the movable rod, the locking rod may be manually moved or pushed along the C-shaped channel member together with the slidable brackets for movement of the cover to an uncovered position of the pit opening.

The safety cover of the preferred embodiment of the present invention may be installed in a minimum of time with a minimum of assembly steps. The C-shaped channels are secured to tire guides along opposed sides of the pit opening. The fabric pit cover is preassembled with the longitudinal and transverse webs stitched to each other and the transverse webs stitched at their ends to provide loops about the mounting brackets. The mounting brackets include externally threaded bolts which are received within the C-shaped channels and nuts threaded onto the bolts provide a selective tensioning of the cover. One end of each longitudinally extending web is secured about a fixed rod adjacent one end of the pit opening, and the other end of each longitudinally extending web is secured about a movable rod which may be releasably locked at the other end of the pit opening.

Another embodiment of the present invention utilizes flexible cables for supporting the fabric webbing with adjustable webbing supports for supporting the webbing on the cables for sliding movement. The adjustable supports fit within webbing loops and are adjustable in length on the cable to vary the tautness or tension in the transverse webbing rows.

It is an object of this invention to provide a safety cover for a service pit opening which may be easily moved manually between covered and uncovered positions of the opening.

It is a further object of the invention to provide such a cover formed of a fabric webbing which is easily folded and stored upon movement of the cover to an open position.

Another object of this invention is to provide a cover which may be easily packaged for shipment to a desired location for installation, and then installed in a minimum of time.

Other objects, features, and advantages of the invention will be apparent from the following specification and drawings.

BRIEF DESCRIPTION OF THE DRAWINGS

FIG. 3 is an enlarged top plan of a portion of the safety cover showing a movable end of the cover with the support members mounted for sliding movement along a C-shaped guide rail;

FIG. 4 is an enlarged section taken generally along line 4—4 of FIG. 3;

FIG. 5 is an enlarged section taken generally along line 5—5 of FIG. 1;

FIG. 6 is a plan view of the fixed tension bar for the safety cover adjacent one end of the pit opening for mounting the cover under a desired tensioning;

FIG. 7 is an enlarged perspective of the locking mechanism for releasably securing the movable end of the safety cover at an opposed end of the pit opening in the closed position of the pit cover;

FIG. 8 is an enlarged plan view of a modified support member for the end of a row of web material from which the cover is formed;

FIG. 9 is another embodiment of a support member for the end of a row of web material;

FIG. 10 is a top plan, partly schematic, of another embodiment of a safety cover of the present invention in which the safety cover is supported on flexible cables;

FIG. 11 is an enlarged fragment of FIG. 10 showing transverse rows of webbing supported on the flexible cable for adjustment;

DESCRIPTION OF THE INVENTION

Figure 1:
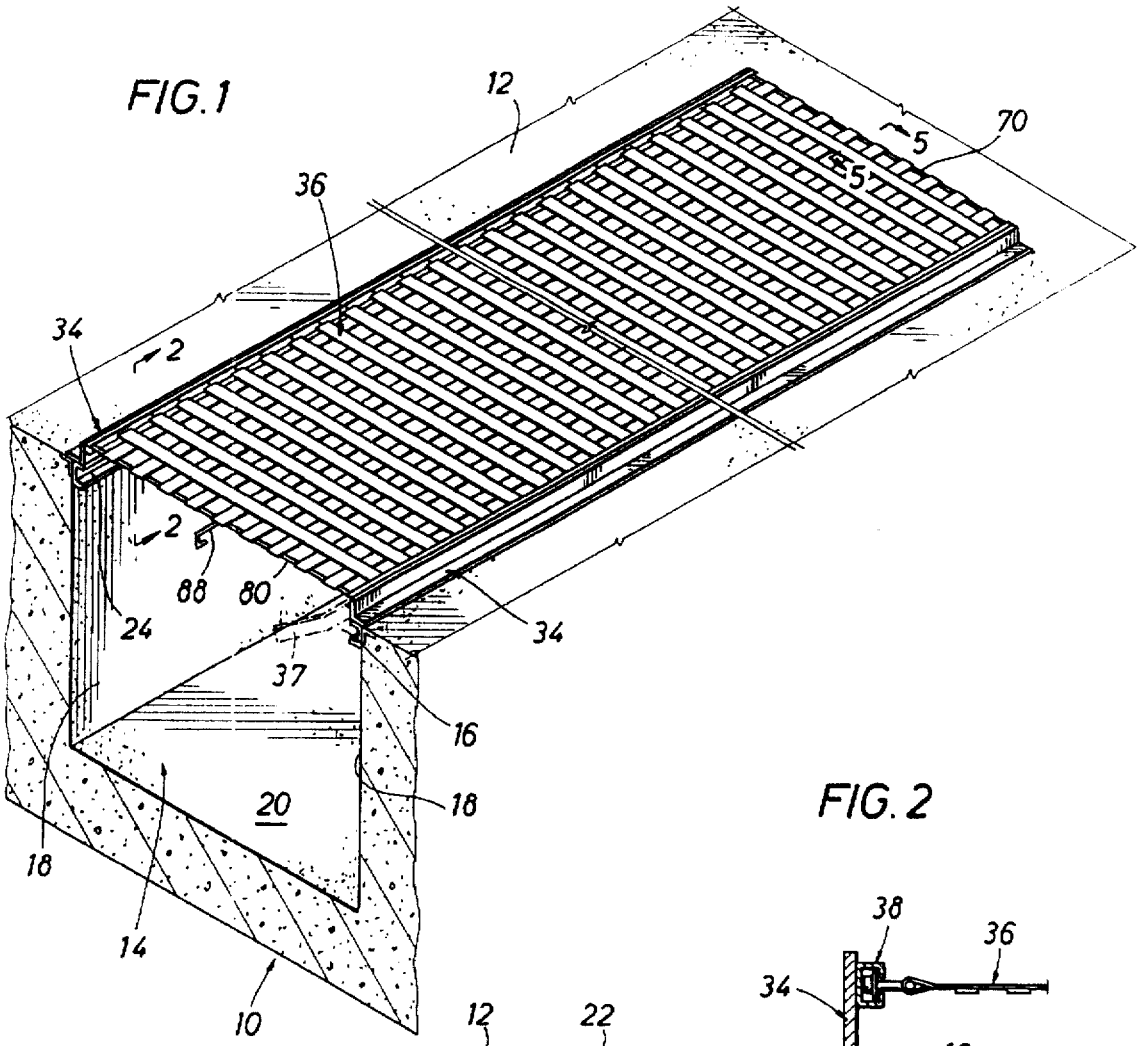
FIG. 1 is a perspective of the preferred embodiment of the safety cover of the present invention shown installed over a rectangular opening of a service pit.

Referring now to the drawings for a better understanding of this invention, and more particularly to the embodiment of the invention shown in FIGS. 1–6, FIG. 1 shows a portion of an automotive service pit for servicing automotive vehicles including a concrete foundation generally indicted at 10. Concrete foundation 10 forms a floor 12 and a pit 14 having an upper generally rectangular opening 16. Pit 14 is provided to receive service personnel to service vehicles over the service pit including lubrication, changing oil, changing filters, and making vehicle repairs. Pit 14 includes side walls 18 and a bottom wall 20.

Figure 2:
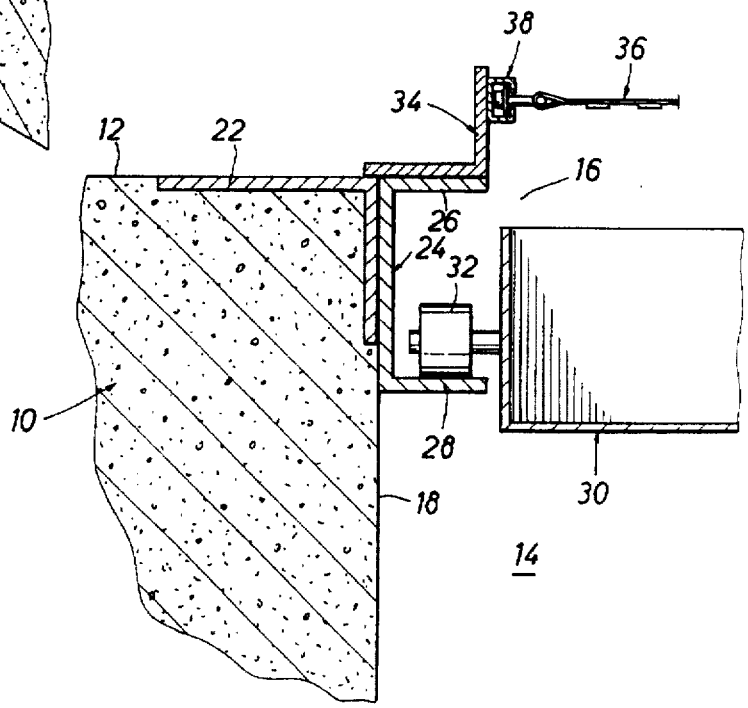
FIG. 2 is a section taken generally along line 2—2 of FIG. 1.
Figure 12:
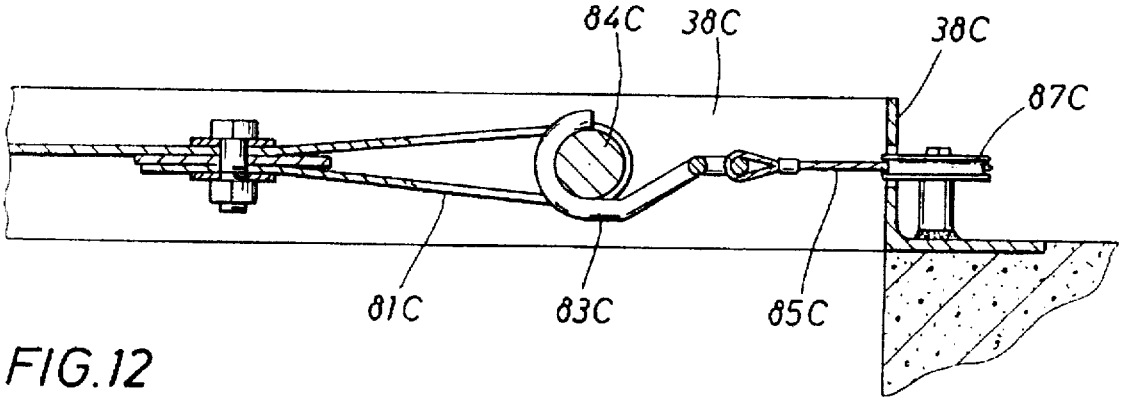
FIG. 12 is section taken generally along line 12—12 of FIG. 11 showing means for anchoring an end rod of the safety cover over the safety pit.

As shown in FIG. 2, each side wall 18 has a reinforcing angle 22 at the corner of pit 14. Secured to the downwardly extending leg of reinforcing angle 22 is a channel generally indicated at 24 having an upper leg 26 and a lower leg 28. An oil drain pan generally indicated at 30 has supporting rollers 32 supported on leg 28 for sliding movement of oil drain pan 30 back and forth by service personnel as desired.

Secured to the upper surfaces of upper leg 26 and reinforcing angle 22 is a tire guide rail generally indicated at 34 adapted to engage the inner surface of a tire to restrict or block movement of the tire to a position over pit 14. An end tire guide 37 is provided at the entrance end pit 14 to engage the tires of a vehicle in the event the wheels of the vehicle are not centered when the vehicle is driven over rectangular opening 16 of pit 14.

A safety cover for rectangular opening 16 of pit 14 is shown generally at 36 and forms an important part of this invention. Safety cover 36 is of a generally rectangular shape for covering rectangular opening 16 of service pit 14. For supporting cover 36 along side walls 18 defining rectangular opening 16, a C-shaped guide rail shown generally at 38 is secured., such as by welding, to the inner surface of each tire guide rail 34. C-shaped support member 38 has inturned upper and lower flanges 40 and 42 defining a slot 44 therebetween as shown particularly in FIG. 4. Further details concerning the support of cover 36 by C-shaped support members 38 will be explained further.

Cover 36 is secured at one end of opening 16 and is moved longitudinally along opening 16 from the other opposite end of opening 16. Cover 36 is adapted for longitudinal movement manually between a closed position of cover 36 when not in service, and an open position of cover 36 when pit 14 is in service. Cover 36 is formed of a fabric material, preferably a flat webbing material such as nylon or polyester with a width of about two (2) inches. A plurality of longitudinally extending columns 46 of the webbing material, and a plurality of transverse extending alternate rows 48 and intervening rows 50 of the webbing material, such as shown in FIG. 3 are illustrated. Columns 46 and row 48, 50 are stitched to each other at the intersections of the separate webs by a suitable stitching pattern as shown at 52, for example.

To mount cover 36 for sliding longitudinal movement, alternate rows 48 have support members generally indicated at 54 mounted on C-shaped support members or guides 38 for sliding movement. Support members 54 comprise T-bolts each having an externally threaded shank 56 and a head 58. As shown in FIG. 4, a loop 60 is formed on each end of each row 48, 50 with stitching 52 securing the loops. For positioning T-bolts 54 on alternate rows 48, a hole or opening 62 is burned at the center of loop 60 by a suitable heating iron. Shank 56 is then inserted within loop 60 and through opening 62. A washer 64 is positioned on shank 56 and a nut 66 is threaded to a position to obtain the desired tensioning of alternate rows 48. When installed, support members of T-bolts 56 may be inserted from an open end of C-shaped support members 38.

For anchoring cover 36 at one end of pit 14, reference is made to FIGS. 5 and 6 in which a loop 69 on the adjacent end of each fabric column 46 extends about a rod or bar 70. An opening 72 for loop 69 is burned in the fabric material centrally of the width of column 46 by a suitable heating iron. Bolts 74 with suitable washers and nuts are positioned within opening 72 for securement of each column 46 about tension rod 70. To position rod 70 for the desired tensioning of web columns 46, a bolt 78 is positioned within aligned openings 77 in legs 40, 42 of C-shaped support members 38 as shown particularly in FIG. 6. Rod 70 abuts a pair of bolts 78 for mounting rod 70 at a predetermined position.

For releasably securing the other movable end of cover 36, columns 46 are looped at 81 about movable rod 80 and the adjacent web row 50 as shown in FIG. 3. Suitable openings are burned into loops 81 and web row 50. Bolts 84 are positioned within the openings with suitable washers 82 over the openings similar to loops 69 as shown in FIG. 5 for the opposite ends of columns 46. A locking hook 88 is secured to rod 80 for releasably locking of end rod 80. A locking mechanism for hook 88 is shown generally at 90- in FIG. 7. A manual handle 94 is pivotally mounted at 91 to mounting bracket 102 secured to concrete foundation 102. Arm 98 secured to handle 94 is pivotally mounted at 100 to bracket 102. Over center links 92 and 93 are pivotally mounted to each other at 95. Link 93 is pivotally mounted to handle 94 at pivot 96 and link 92 has a pin 97 received by hook 88. Handle 94 when depressed downwardly from the position of FIG. 7 pivots links 92, 93 about pivot 95 past dead center portion to permit release of link 92 from hook 88. Thus, cover 36 may be releasably locked in position to prevent inadvertent movement of cover 36.

Cover 36 may be provided as a kit for installation on an existing service pit having tire guide rails. The kit includes a C-shaped rails 38, T-bolts 54, webbing material including columns 46 and rows 48, 50 stitched to each, along with associated loops 60, 69, 81, end bars 70, 80, and locking mechanism 90. For installation, C-shaped support members 38 are first welded to the inner surfaces of tire guide rails 34. The fixed and movable end rods 70 and 80 are cut to the desired length. Alternate rows 48 of the webbing material have holes 62 burned in loops 60 and then T-bolts 54 are inserted in the openings. Washers 64 and nuts 66 are then inserted. T-bolts 54 are then inserted from the ends of the C-shaped support members 38. Next, end support bar 70 is mounted upon burning of openings 72 in the associated web material. Bolts 74 are then secured. Next, bolts 78 are mounted on guide rails 38 for a desired positioning of a fixed bar 70. Openings are then burned in loops 81 and bolts 84 secured within the openings.

Locking mechanism 90 is then mounted on foundation 10 adjacent the rectangular opening 16 for pit 14. A suitable opening for hook 88 is burned or seared in the loop of the center column 46. Then, tension bar 80 is inserted through loops 81 of columns 46. Hook 88 is then secured to bar 80 and adjusted with locking mechanism 90 for the desired tensioning of cover 36.

A modified support member for alternate webbing rows 48 is shown in FIG. 8 in which a U-bolt 54A is mounted on loop 60 of row 48. Suitable washers 64A and nuts 66A are provided on the ends of U-bolt 54A which is adapted for mounting within slot 44 of the C-shaped support member 38. The arrangement shown in FIG. 8 does not require any openings to be burned in loop 60 in order to mount U-bolt 54A.

FIG. 9 shows another modification in which a support member 54B is provided which may be inserted through loop 60 of a row 48 without the provision of any separate opening in the fabric material to receive support member 54B. Support member 54B is adapted for mounting within slot 44 of C-shaped support member 38 in the same manner as U-shaped bolt 54A.

From the above, a safety cover comprising the present invention has been provided from a strong webbing material. As an example, a woven webbing material formed of polyester having a width of two inches and a 6,000 pound tensile strength has been found to be satisfactory. The rows 48, 50 of the web material are preferably spaced at centers four inches apart. Columns 46 of the webbing material may also be spaced with their centers four inches apart. Support members 54 in alternate rows 48 are spaced with their centers eight inches apart. For stitching of the webbing material to each other and to form loops, various stitch patterns have been utilized. Stitch patterns which have a recommended working load limit of ⅓ of the minimum break strength of the webbing material are selected by the manufacturer of the webbing material. The cover of the present invention shown in FIGS. 1–7 may be installed on an existing service pit by two installation personnel in around four to eight hours. While the cover is shown as extending for the entire length of the rectangular opening of the service pit, it may be desirable, under certain conditions, for the cover to extend only for one half the length of the service pit. In this type of installation, another suitable releasable locking mechanism may be utilized for the movable bar.

Referring now to FIGS. 10–14, another embodiment of the safety cover forming the present invention is illustrated in which the safety cover is supported on flexible cables. Safety cover 36C is generally similar to safety cover 36 and is formed of a flat fabric webbing material such as nylon or polyester, for example. Cover 36C includes a plurality of longitudinally extending spaced columns 46C and a plurality of transversely extending spaced rows 48C formed of flat webbing material. Columns 46C and rows 48C as stitched to each other by a suitable stitching pattern. A loop 60C is formed on each end of each row 48C and a loop 81C is formed on each end of each column 46C.

To support cover 36C, an outer rigid frame generally indicated at 37C is provided having a rectangular shape and comprised of angle shaped frame members 38C secured to each other. Frame 37C is secured to the pit foundation about the pit opening. Mounted on each corner of rectangular frame 37C is a fixed eye 39C. A flexible cable 41C is secured within each eye 39C and the ends of cable 41C are anchored to a turn buckle 43C which may be manually adjusted to provide the desired tensioning of cable 41C.

Figure 13:
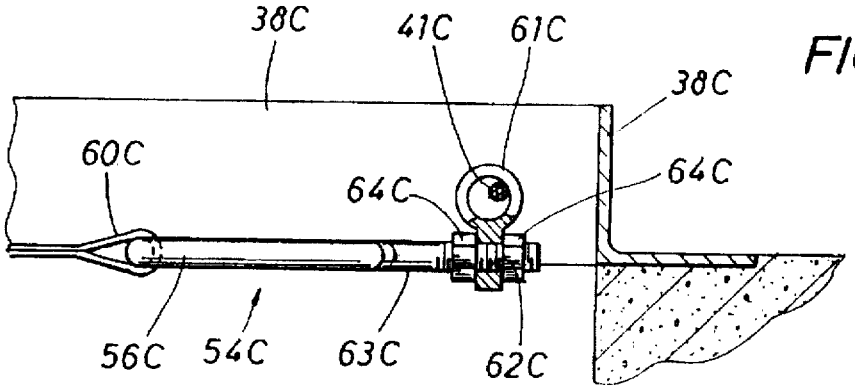
FIG. 13 is section taken generally along line 13—13 of FIG. 11 showing the adjustable support for supporting the webbing on the flexible cable.
Figure 14:
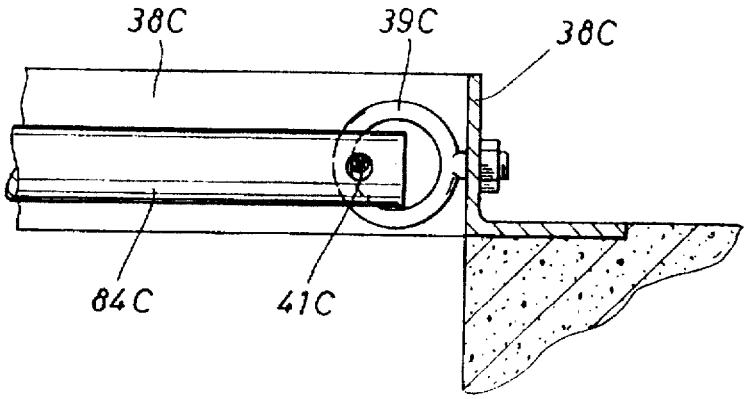
FIG. 14 is a section taken generally along line 14—14 of FIG. 11 and showing releasable locking means for the end rod of the safety cover.

Transverse rows 48C of fabric webbing are supported on the longitudinal runs of cable 41C. Referring to FIGS. 11 and 13, a webbing support is shown generally at 54C, including a clasp 56C received within loop 60C and having an externally threaded pin 63C thereon. A metal ring or clasp 61C fits about cable 41C and has an extension with an internally threaded opening 62C. Pin 63C is threaded within opening 62C of clasp 61C and a pair of nuts 64C are adjustably mounted on pin 63C to obtain the desired tension or tautness in a fabric row 48C. While clasps 56C have been shown for each loop 60C, it may be desirable to provide clasps 56C only for alternate loops 60C.

One end of fabric cover 36C is fixed and the opposite end is movable. An end anchor bar or rod 80C is secured to the adjacent end frame member 38C and loops 81C of webbing columns 46C are secured about rod 80C to secure one end of safety cover 36C. The other end of safety cover 36C has a movable rod 84C and loops 81C of webbing columns 46C receive rod 84C. A hook 83C is positioned over rod 84C and a cable 85C extends from hook 83C over pulley 87C to a shaft 89C on a locking mechanism shown in FIG. 11 at 90C which is similar to the locking mechanism 90 shown in FIG. 7 of the embodiment of FIGS. 1–7. Upon release of locking mechanism 90C, safety cover 36C may be moved manually along cable 41C toward fixed rod 80C for storage. While locking mechanism 90C is shown as mounted on frame 37C, locking mechanism 90C may be mounted on a wall of the pit foundation, if desired.

Since certain changes or modifications may be made in the disclosed embodiments without departing from the inventive concepts involved, it is the aim of the appended claims to cover all such changes and modifications falling within the true spirit and scope of the present invention.

What is claimed is:

1. For an automotive service pit having a generally rectangular floor opening; an improved covering device for covering the rectangular floor opening comprising:

a pair of longitudinally extending cover support members for securement along said rectangular opening;

a flexible cover for said rectangular opening of a width less than the width of said rectangular opening and supported on said pair of support members; said cover comprising a web net formed of a fabric material and including a plurality of spaced transverse webs connected to a plurality of spaced longitudinal webs;

a plurality of anchor members having an outer end mounted on said cover support members for sliding movement along said cover support members, said anchor members having inner ends thereof mounted on selected transverse webs for supporting said cover for manual sliding movement along said cover support members;

said transverse webs having loops on opposed ends thereof and said anchor members being received within said loops;

adjustable means on said anchor members to adjust the length of said anchor members to provide a desired tautness to said selected transverse webs; and means for removably securing one end of said cover to permit movement of said anchor members and cover between covered and uncovered positions of said floor opening.

2. The improved covering device as set forth in claim 1 wherein:

said longitudinal webs have loops on opposed ends thereof, and a transverse end rod is received within said loops at each end of said longitudinal webs, one of said end rods being fixed and the other of said end rods mounted for movement along the length of said opening.

3. Apparatus for covering a generally rectangular floor opening of an automotive service pit comprising:

a pair of fixed longitudinally extending alongside said rectangular opening for guiding the inner surfaces of tires of an automotive vehicle over the floor opening for servicing of the vehicle;

a pair of longitudinally extending cover support guides fixed to said tire guide rails and extending alongside said tire guide rails over said rectangular opening;

a flexible cover for said rectangular opening of a width less than the width of said rectangular opening;

a plurality of anchor members mounted at selected horizontal intervals to opposed sides of said flexible cover, said anchor members having an extending end thereof mounted on an adjacent support guide for sliding manual movement along the adjacent cover support guide; and means for securing one end of said cover to permit movement of said anchor members and cover between covered and uncovered positions of said cover;

said cover support guides comprising C-shaped channels and said anchor members having extending threaded ends received within said C-shaped channels for sliding movement, and adjustable nuts on said threaded ends to adjust the effective length of said anchor members between said C-shaped channels and said cover.

4. Apparatus as set forth in claim 3 wherein:

said flexible cover comprising a web net formed of a fabric material and including a plurality of spaced flat transverse webs secured to a plurality of spaced flat longitudinal webs, each of said webs having ends with web loops therein;

and said anchor members are received within selected web loops of said transverse webs.

5. Apparatus as set forth in claim 4 wherein:

said anchor members are adjustable in length to provide a desired tautness to selected transverse webs.

6. Apparatus for coveting a generally rectangular floor opening of an automotive services pit comprising:

a pair of fixed longitudinally extending tire guide rails for extending alongside said rectangular opening for guiding the inner surfaces of tires of an automotive vehicle over the floor opening for servicing of the vehicle;

a pair of longitudinally extending cover support guides fixed to said guide rails and rails and extending alongside said guide rails over said rectangular opening;

a rigid longitudinal guide mounted on each tire guide rail along each side of said rectangular opening;

a flexible cover for said opening of a rectangular shape generally similar to the shape of said generally rectangular opening of said pit and having a width less than the width of said opening; said cover including a plurality of spaced columns of flexible material and a plurality of spaced transverse rows of flexible material;

a plurality of anchor bolts mounted on opposed ends of selected transverse rows of said flexible material;

adjustable means on said bolts connected to said guides for adjustment to provide a desired tautness to said selected rows;

means at one end of said opening for anchoring one end of said cover thereat; and releasable means at the other end of said cover to permit manual horizontal movement of said cover upon release thereof along said guides toward said one end for removing said cover from said opening.

7. Apparatus as set forth in claim 6 wherein:

said selected transverse rows of said flexible material comprise flat webbing material with each row having looped ends;

said anchor bolts being received within said looped ends of said selected transverse rows.

8. Apparatus as set forth in claim 7 wherein:

said anchor bolts are generally T-shaped with a portion thereof fitting within said looped ends.

9. Apparatus for covering a generally rectangular floor opening in a foundation of an automotive service pit comprising:

cable support members for mounting on said foundation in a fixed relation;

a pair of longitudinally extending parallel cable members extending along opposite sides of said rectangular floor opening;

a flexible cover for said rectangular opening comprising a web net formed of flat webbing material, said web net including a plurality of transverse rows of spaced flat transverse webs and a plurality of columns of spaced flat longitudinal webs secured to each other;

anchor members secured to the ends of selected transverse rows and mounted on said cable members for sliding movement; and means to adjust the length of said anchor members to provide a desired tautness to said selected transverse webs.

10. Apparatus as set forth in claim 9, wherein:

a web loop is provided for each end of said transverse rows; and said anchor members are received within the web loops for said selected transverse rows.

11. Apparatus as set forth in claim 9 wherein:

a web loop is provided for each end of said longitudinal columns, and a transverse end rod is received within said loops at each end of said columns, one of said rods being fixed and the other of said rods being mounted on said cable members for sliding movement along said cable members.

12. Apparatus as set forth in claim 11 wherein:

means are provided to releasably secure the movable rod at an end of said opening.

13. For an automotive service pit having a generally rectangular floor opening; an improved covering device for covering the rectangular floor opening comprising:

a pair of longitudinally extending cover support members comprising flexible cables for securement along said rectangular opening;

a flexible cover for said rectangular opening of a width less than the width of said rectangular opening and supported on said pair of support members; said cover comprising a web net formed of a fabric material and including a plurality of spaced transverse webs connected to a plurality of spaced longitudinal webs;

a plurality of anchor members having an outer end mounted on said cover support members for sliding movement along said cover support members, said anchor members having inner ends thereof mounted on selected transverse webs for supporting said cover for manual sliding movement along said cover support members;

adjustable means on said anchor members to adjust the length of said anchor members to provide a desired tautness to said selected transverse webs; and means for removably securing one end of said cover to permit movement of said anchor members and cover between covered and uncovered positions of said floor opening.

* * * * *